United States Patent [19]

Villa

[11] 4,257,612

[45] * Mar. 24, 1981

[54] OPTOELECTRONIC AMUSEMENT DEVICE

[75] Inventor: Alvaro J. Villa, Northridge, Calif.

[73] Assignee: Walt Disney Productions, Burbank, Calif.

[ * ] Notice: The portion of the term of this patent subsequent to Apr. 24, 1996, has been disclaimed.

[21] Appl. No.: 968,910

[22] Filed: Dec. 13, 1978

Related U.S. Application Data

[63] Continuation-in-part of Ser. No. 718,369, Aug. 27, 1976, Pat. No. 4,150,824.

[51] Int. Cl.[3] ..... F41J 5/08; A63F 9/02

[52] U.S. Cl. ..... 273/310

[58] Field of Search ..... 35/25; 273/101, 101.1; 307/96, 132

[56] References Cited

U.S. PATENT DOCUMENTS

| | | | |
|---|---|---|---|
| 2,181,948 | 12/1939 | McClellan | 273/101.1 |
| 2,629,598 | 2/1953 | Hooker | 273/101.1 |
| 3,549,147 | 12/1970 | Katter | 273/101.1 |
| 3,588,108 | 6/1971 | Ormiston | 273/101.1 |
| 3,798,795 | 3/1974 | Michelsen | 35/25 |
| 3,811,204 | 5/1974 | Marshall | 273/101.1 |
| 3,847,396 | 11/1974 | Ashford | 273/101.1 |
| 3,956,704 | 5/1976 | Keeney, Jr. et al. | 307/260 |
| 3,956,710 | 5/1976 | Seitz et al. | 307/233 R |
| 3,995,376 | 12/1976 | Kimble et al. | 273/101.1 |
| 4,063,368 | 12/1977 | McFarland et al. | 35/25 |
| 4,097,156 | 6/1978 | Garber et al. | 273/101.1 |
| 4,150,824 | 4/1979 | Villa | 273/101.1 |

*Primary Examiner*—Vance Y. Hum

*Attorney, Agent, or Firm*—Fulwider, Patton, Rieber, Lee & Utecht

[57] ABSTRACT

An optoelectronic amusement device has a transmitter that emits pulses of a controlled pulse train duration, pulse rate and pulse width, and at a frequency of at least about 1800 hertz. A receiver is employed which is sensitive to the pulse rate and frequency of the transmitter. The transmitter is incorporated into a firearm replica for a shooting gallery and the receiver is a target displaying a visible light source which is extinguished for a predetermined time period when energy from the transmitter strikes the target.

2 Claims, 6 Drawing Figures

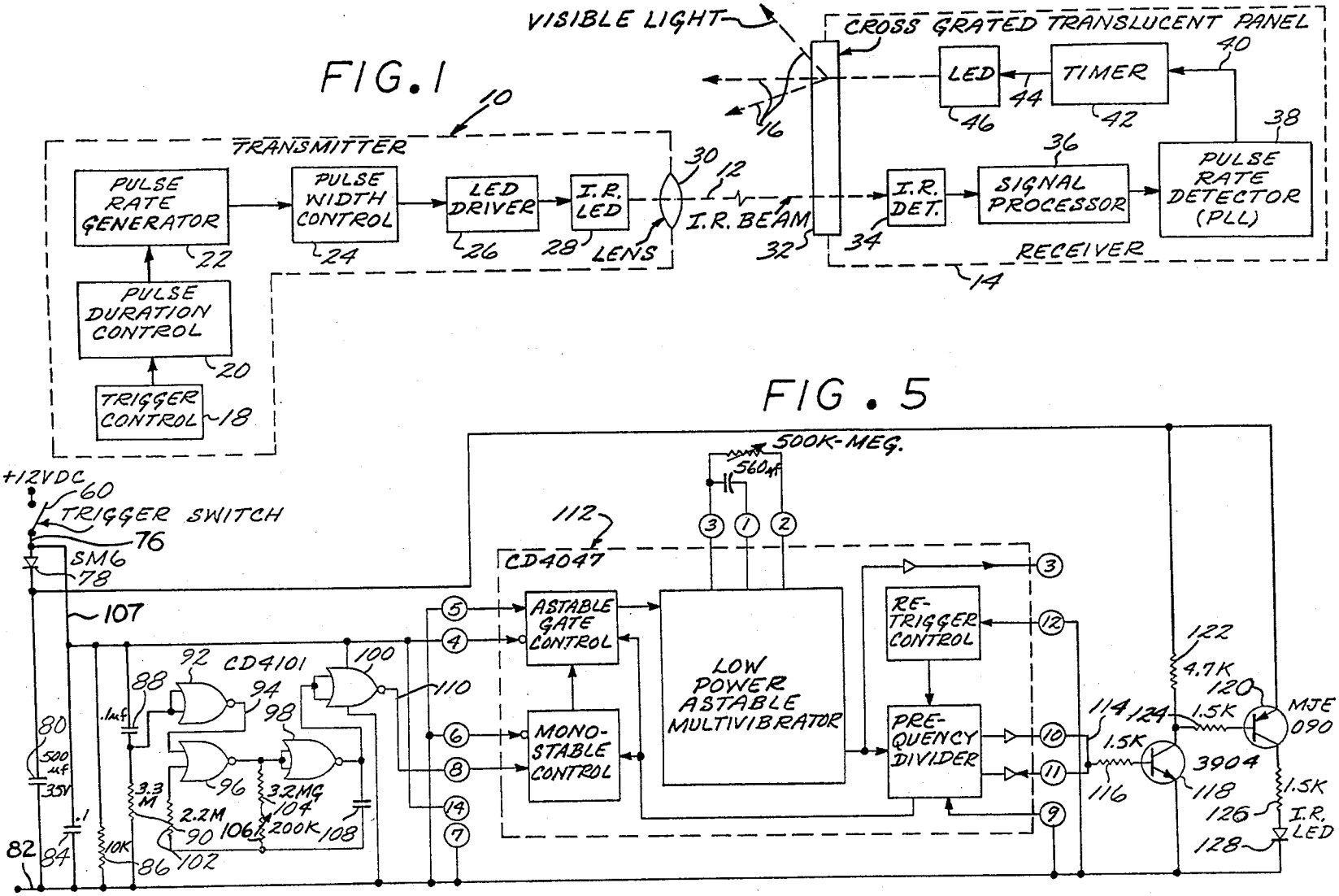
FIG. 1
FIG. 5
VISIBLE LIGHT
CROSS GRATED TRANSLUCENT PANEL
TIMER
LED
PULSE RATE DETECTOR (PLL)
SIGNAL PROCESSOR
I.R. DET.
RECEIVER
I.R. BEAM
LENS
I.R. LED
LED DRIVER
PULSE WIDTH CONTROL
TRANSMITTER
PULSE RATE GENERATOR
PULSE DURATION CONTROL
TRIGGER CONTROL
TRIGGER SWITCH
+12VDC
TRIGGER
SM6
500K-MEG.
LOW POWER ASTABLE MULTIVIBRATOR
RE-TRIGGER CONTROL
PRE-QUENCY DIVIDER
ASTABLE GATE CONTROL
MONO-STABLE CONTROL
CD4047
CD4101
MJE 090
3904
I.R. LED FIG. 2
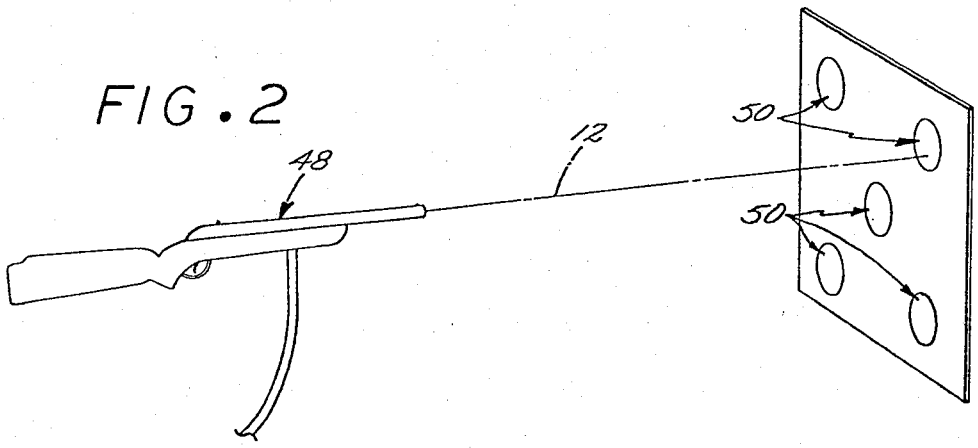
FIG. 3
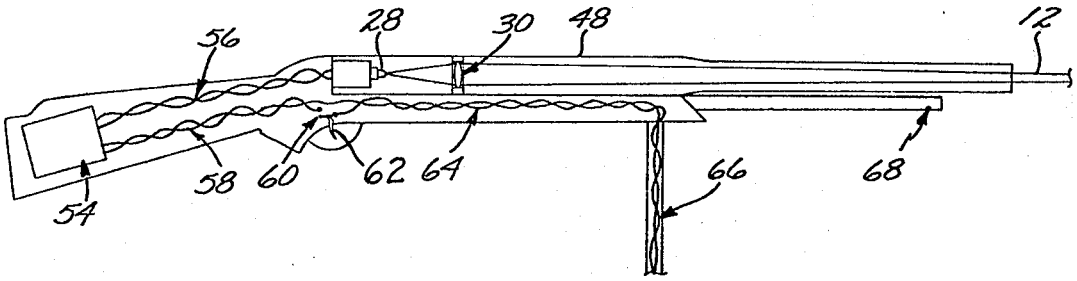
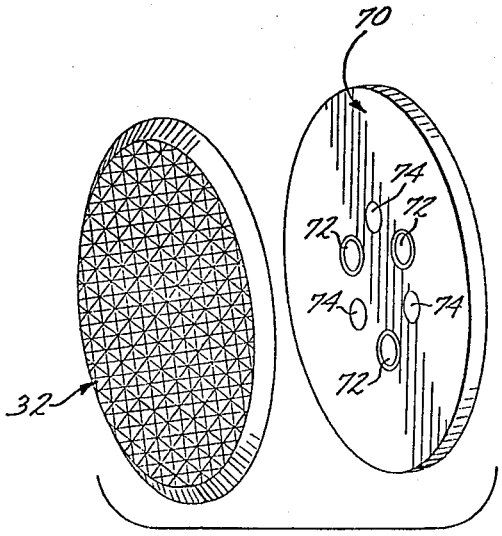
FIG. 4

OPTOELECTRONIC AMUSEMENT DEVICE

This is a continuation-in-part of U.S. Pat. application Ser. No. 718,369 filed Aug. 27, 1976, now U.S. Pat. No. 4,150,824.

BACKGROUND OF THE INVENTION

1. Field of the Invention

The present invention pertains to amusement devices employing a signal transmitter and receiver operating in the optical spectrum, and more particularly to an amusement park shooting gallery system using light guns.

2. Description of the Prior Art

Many prior art optical transmission systems in amusement devices are responsive to continuous light and the receivers in such systems are subject to being triggered by spurious or random light. Even in systems where frequency gating is employed, conventional gating systems allow false triggering. A principal reason for the registration of false hits in conventional systems is that the 60 cycle 120 volt a.c. current, typically used as a primary power source, generates harmonic frequencies in the gating system. Conventional optical transmission systems in amusement devices typically employ mechanical shutters. For example, U.S. Pat. No. 4,054,290 describes such a gating system in which the sensitive frequency is 400 hertz. This system uses a tuning fork to physically and intermittently block an aperture through which light is transmitted.

Because of the low triggering frequency employed in conventional amusement devices that utilize frequency gating, the harmonics developed from the 60 cycle a.c. power supply are of a sufficient strength to trigger the receiver and cause the registration of false hits. It should be noted that the strength of a harmonic signal will decrease with increased frequency above the base signal. That is, the first harmonic of a 60 hertz signal is 120 hertz, and is stronger than the second harmonic, which is 240 hertz. Similarly, the second harmonic is stronger than the third harmonic of 480 hertz. It should also be noted, especially when dealing with an unregulated 60 hertz supply, that complex frequencies are likely occur to approximate almost any frequency. Thus, even when no exact integral harmonic of the a.c. supply corresponds precisely to a triggering frequency, such as the 400 hertz system described in U.S. Pat. No. 4,054,290, the combined frequencies of the harmonics produced do approximate almost any frequency. Conventional frequency sensitive receivers in amusement devices have heretofore been set at frequencies far too low to avoid the effects of combined harmonics of the operating power source and other spurious noise.

For particular applications, such as the use of a light gun for amusement park shooting galleries, such prior art systems have further disadvantages in that a continuously generated light beam, pulsed or not, permits the shooter to hunt around the target with the beam on until the target is hit.

Thus, for particular applications, such as light guns for shooting galleries, there has long been a need for a system which permits the transmitting gun to emit optical energy for only a brief period of time when the trigger is pulled and a receiving target which is not responsive to spurious light or noise harmonics. The present invention satisfies that need.

SUMMARY OF THE INVENTION

The optoelectronic communication system of the present invention provides a transmitter which permits the emission of energy in the optical spectrum including the infrared, visible and ultraviolet ranges only in a very controlled manner which has advantages in light gun applications for shooting galleries. The receiver of the system also responds only to the high frequency of a signal emitted by the transmitter and has the further advantage of providing a visible indication of when the target is hit by the light beam.

In the presently preferred embodiment of the invention, the pulse train duration, the pulse rate and pulse width of an infrared light beam is controlled and activated by pulling the trigger of a replica of a firearm. The receiving target continuously displays a visible light source which is extinguished for a predetermined time period when struck by infrared energy from the transmitter. Thus, the optoelectronic communication system of the present invention has particular advantage in at least one application, a light gun for use in an amusement park shooting gallery although the system of the invention could be used to advantage in other applications.

BRIEF DESCRIPTION OF THE DRAWINGS

FIG. 1 is a diagrammatic and block diagram representation of the optical communication system of the present invention;

FIG. 2 is a pictorial view illustrative of an embodiment of the system;

FIG. 3 is a diagrammatic view of a firearm replica illustrating the incorporation of the invention;

FIG. 4 is an exploded perspective view of a portion of the receiver of the system;

FIG. 5 is an electrical schematic diagram of the controlled power supply for the infrared light source.

DESCRIPTION OF THE PREFERRED EMBODIMENT

Figure 6:
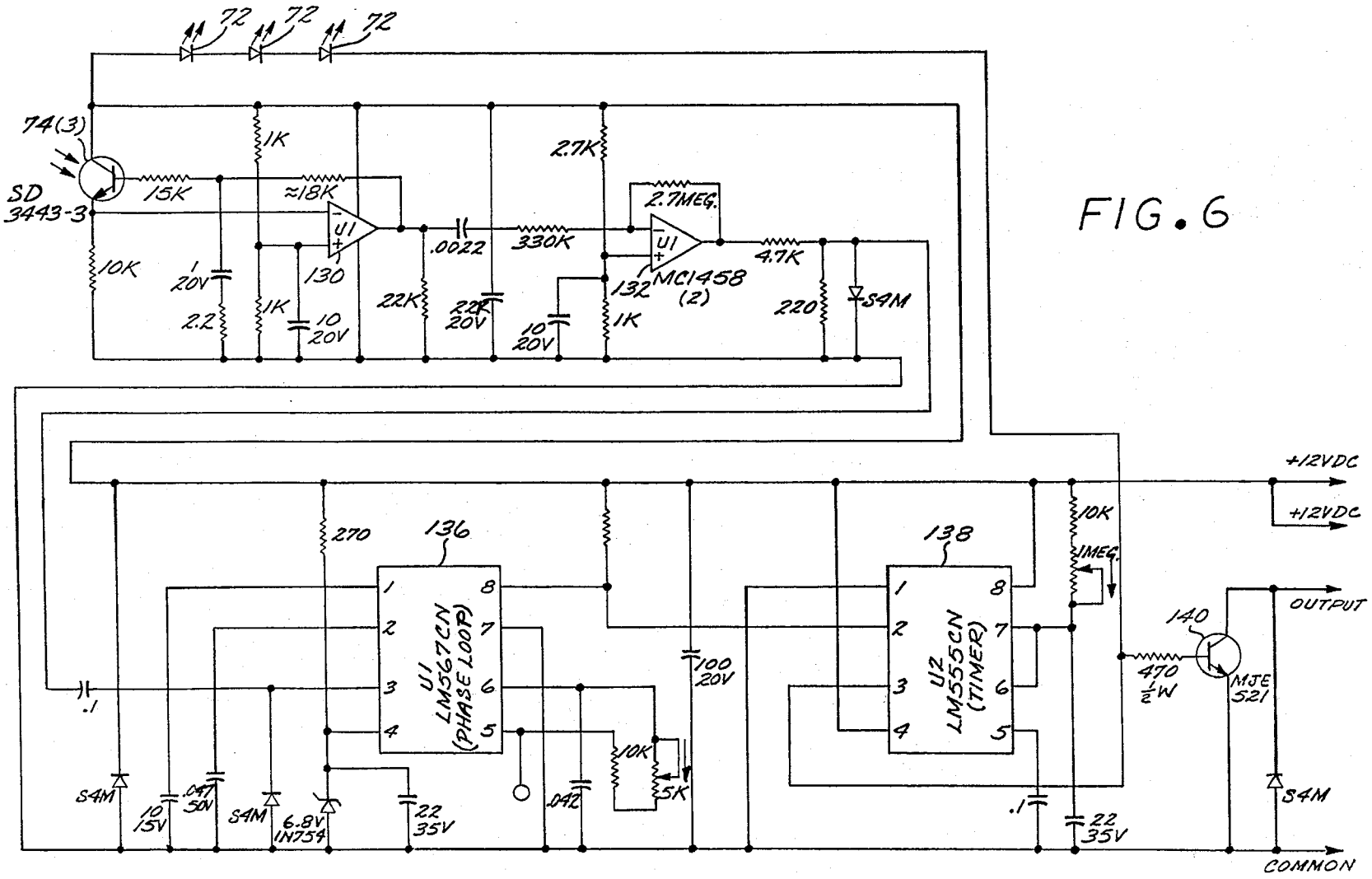
FIG. 6 is an electrical schematic diagram of the receiver of the invention.

Turning now to the drawings, and particularly FIG. 1 thereof, the system of the invention is illustrated by means of a diagrammatic view. A transmitter 10 generates an infrared beam, such as that illustrated by the phantom line 12, which is aimed at a receiving target 14. The receiver continuously emits visible light such as illustrated by the lines 16, and when the infrared beam strikes the target 14, that visible light is extinguished for a predetermined time period to indicate that the target has been hit.

The emitted infrared beam 12 has characteristics which are particularly advantageous for the illustrated application. Thus, as illustrated in FIG. 1, a trigger control 18 enables a pulse train duration control 20 which activates a pulse rate generator 22 for a particular time period which, in the illustrated application, is relatively short to simulate the firing of a gun. The pulse rate generator supplies pulses to a pulse width control 24 which generates relatively short pulses that are applied to a light-emitting diode driver 26 which powers the infrared light-emitting diode 28. The pulses supplied to the infrared light-emitting diode 28 are made relatively short in order to generate an infrared pulse of relatively high power without exceeding the rating of the diode.

The diode 28 utilized in the illustrated application generates substantially a point source of light which is applied to a lens 30 that focuses the infrared energy from the diode into a narrow beam 12. The narrow infrared beam 12 passes through a translucent panel 32 which has a crossed grating thereon, depicted in FIG. 4, to diffuse the emitted visible light into beams 16.

The infrared beam 12 is detected by an infrared detector 34, illustrated in FIG. 1, which is tuned to detect visible light at a specific frequency of at least about 1800 hertz. The detector 34 supplies a signal to a signal processor 36, which is primarily an amplifier. The signal processor 36 in turn supplies an amplified signal to a pulse rate detector 38 which is in the form of a phase-locked loop. If the pulse rate received by the infrared detector is proper, a signal is generated on a line 40 which activates a timer 42 to generate an inhibiting signal for a preset time period on a line 44. The inhibiting signal on line 44 is applied to the light-emitting diodes 46 which generate the visible light 16.

FIG. 2 illustrates a particular application of the opto-electronic amusement device of the invention. In the embodiment depicted, a replica of a firearm 48 may be aimed at a plurality of targets 50 in the form of the translucent panels 32 described above to emit beams 12 of visible light.

The incorporation of the transmitting portion of the invention into the firearm replica 48 is illustrated in FIG. 3. The infrared light-emitting diode 28, which is substantially a point source of light, is mounted within the replica approximately where the conventional firearm breech would be. Since the diode 28 emits substantially a point source of light, that light can be focused into a substantially narrow beam by a single achromatic lens 30. The rectified d.c. power supply 54 for the diode 28 is mounted within the stock of the replica 48, with the power supply being connected to the diode 28 through a power line 56. The d.c. power supply 54 itself is supplied with power through a line 58 which is controlled by a switch 60 which is activated by the trigger 62. The power line 64 supplying the switch 60 is connected to the firearm replica 48 through an air line 66. When the trigger 62 and switch 60 are closed, power is supplied to the power supply 54. Although the power in the system is 12 volts d.c., this power is ultimately derived from a 60 hertz line frequency is therefore present within the system. Closure of switch 60 also closes the circuit on a solenoid (not shown) which operates an air valve which permits a burst of air to be connected through the tube 66 and eventually exit out of an orifice 68 which not only produces a realistic noise, but simultaneously produces the typical "kicking" reaction of a firearm.

In order for the receiving target units to both generate visible light and receive infrared radiation, a construction shown in FIG. 4 is utilized in which a receiver circuit board 70 has arrayed on its face alternate light-emitting diodes 72 and infrared detectors 74. The circuit board 70 is placed behind the translucent panel 32 which is provided with crossed gratings to diffuse the light generated by the light emitting diodes 72 to provide even illumination of the panel. The incoming infrared radiation is also slightly diffused so that it may be received by the infrared detectors 74.

An electrical schematic diagram of the infrared transmitter is shown in FIG. 5. Closure of the trigger switch 60 applies 12- volts d.c. to the circuit. The 12-volts is connected through line 76 to the timing circuits and connected through a decoupling diode 78 to a large filter capacitor 80 which supplies filtered 12-volts on a line 82 to the diode driver to be described below. The 12-volts d.c is connected through line 76 to a pulse train duration control circuit, which includes capacitor 84, resistor 86 and the series circuit of capacitor 88 and the resistor 90, the junction of which serves as an input to both input terminals of a NOR gate 92. The charging of the discharged capacitor initially activates a signal on line 94 at the output of NOR gate 92 which enables an 1800 Hz oscillator that includes the three NOR gates 96, 98 and 100, and their associated resistors and capacitor 102-108. Together, the NOR gate 92 and the 1800 hertz oscillator form a frequency gating circuit to produce a high frequency output. The frequency of this output is at least about 1800 hertz. It should be noted that because of the power supply connection on line 107 the various noise harmonics of the 60 hertz a.c. source are introduced into the frequency gating system.

The output of the oscillator on line 110 is a substantially symmetrical square wave which is connected an an input to a conventional and commercially available mono-stable multivibrator 112. The mono-stable multivibrator 112 forms a pulse width control circuit. The timing circuit of multivibrator 112 is selected to produce a substantially narrow pulse train at its output on line 114. The narrow pulse train is connected as an input through resistor 116 to the input of the diode driver which includes transistors 118 and 120 and associated biasing resistors 116, 122, 124 and 126. Transistor 118 and 120 are connected to the infrared light-emitting diode 128.

It should be appreciated that in the frequency gating arrangement, when the capacitor 88 in the pulse train duration control circuit has charged to a predetermined value, the state of the NOR gate 92 will change and the oscillator circuit will be inhibited. It has been found that a pulse train duration of approximately 200 miliseconds supplies adequate energy for activating the receiving circuits to be described below. Thus, the transmitting light-emitting diode 128 is on for a relatively short time period. In order to generate another burst of infrared energy, the trigger switch 60 must be released so that the capacitor 88 can discharge.

FIG. 6 is an electrical schematic diagram of the receiver circuitry. The receiver circuitry includes one infrared detector 74, the output of which is connected to a signal processing circuit including operational amplifiers 130 and 132 and their associated biasing resistors and capacitors. The output of the signal processing amplifier is connected as an input to a conventional phase-locked loop 136 with its associated external circuitry-chosen so that the phase-locked loop is connected an an input to a conventional timer 138 having its associated external circuitry set for a 1–2 second time period. The output of the timer is then connected to three light emitting diodes 72. It should be appreciated that when the timer 138 is triggered, the output line from pin 3 goes to a logical "1" which removes the power from the light-emitting diodes 72, thereby turning them off. The output of the timer 138 is also connected as an input to a transistor 140, the output of which can be used to generate a scoring signal on auxiliary equipment (not shown).

By employing an oscillation frequency of at least 1800 hertz in transmitting the infrared signals, the present invention not only avoids the generation of false hit indications due to harmonics of the 60 hertz a.c. power supply, but also is insensitive to low frequency ambient infrared interfering light in the vicinity of the infrared receiver in the target 14. This ambient infrared "noise" may be caused by recurring reflections from mirrors on a carrousel, reflections from cars on a roller coaster, and innumerable other light sources present with the great activity of an amusement park. The registration of such optical noise as false hits in a target device causes considerable irration to cliental participating in target shooting, particularly when it occurs moments before actuating the trigger switch, such as the switch 60 in the present application.

The optical communication system of the present invention affords general advantages in the character of the infrared signal emitted from the transmitter and affords particular advantages in the illustrated application of a transmitter and receiver in the form of a firearm replica and a target for a shooting gallery for amusement parks. While a particular presently preferred embodiment of the invention has been described in detail, it should be appreciated that there may be other applications for the system of the invention. Therefore, the scope of the invention is not to be limited, except by the following claims.

I claim:

1. An optoelectronic transmitter means for use in an amusement park shooting gallery, said transmitter means emitting infrared energy and being mounted in a firearm replica, said transmitter means including:

transducer means for converting electrical input energy into infrared energy, said transducer means being mounted in said replica to emit said infrared energy along a barrel of said replica;

lens means mounted in said barrel for focusing said infrared energy into a narrow beam which emanates from said barrel;

pulse generating means for generating electrical input energy including frequency gating means for gating pulses at a predetermined pulse rate of at least about 1800 hertz frequency to said transducer means, said pulse generating means being selectively enabled by a manual trigger signal, said pulse generating means including a monostable multivibrator triggered by an oscillator; and pulse train duration control means connected to said pulse generator means for operating said pulse generator means only for a predetermined time duration, said pulse train duration control means including a resistor-capacitor timing circuit with its output connected to the inputs of a NOR gate, the output of the NOR gate being connected to said pulse generator means whereby the charging of said capacitor to a predetermined voltage causes said NOR gate to change state.

2. The optoelectronic amusement device of claim 1 including:

trigger means for actuating said pulse train duration control means in response to an externally controlled trigger signal, said trigger means connecting a source of voltage to said resistor-capacitor timing circuit.

* * * * *